US005109548A

United States Patent [19]

Balaban et al.

[11] Patent Number: 5,109,548

[45] Date of Patent: May 5, 1992

[54] WEATHER-ADAPTABLE SKI HAT

[75] Inventors: Jeffrey B. Balaban, Camarillo; James B. Olmes, Agoura; Jerris E. Greenblat, Sunset Beach, all of Calif.

[73] Assignee: Ski Tote U.S.A., Camarillo, Calif.

[21] Appl. No.: 646,061

[22] Filed: Jan. 25, 1991

[51] Int. Cl.[5] ..... A42B 1/00

[52] U.S. Cl. ..... 2/175; 2/173; 2/202; 2/209.1; 2/209.3

[58] Field of Search ..... 2/171, 171.4, 171.5, 2/171.6, 171.7, 171.8, 173, 175, 184.5, 202, 203, 206, 209.1, 209.3, 423, 424, 425, DIG. 11, 198

[56] References Cited

U.S. PATENT DOCUMENTS

| | | | |
|---|---|---|---|
| 54,049 | 4/1866 | White | 2/175 |
| 160,844 | 3/1875 | Schwarz . | |
| 882,648 | 3/1908 | Neugass . | |
| 1,017,049 | 2/1912 | Greenwood | 2/173 |
| 1,023,677 | 4/1912 | Pass | 2/209.3 |
| 1,179,473 | 4/1916 | Taylor | 2/184.5 |
| 1,598,379 | 8/1926 | Kerr . | |
| 1,709,578 | 4/1929 | Ingram | 2/209.3 |
| 2,116,076 | 5/1938 | Lipton | 2/171.5 |
| 2,168,765 | 8/1939 | Dowd | 2/209.3 |
| 2,185,306 | 1/1940 | Marks | 2/198 |
| 3,072,916 | 1/1963 | Henderson | 2/209.1 |
| 3,131,401 | 5/1964 | Brown | 2/175 |
| 3,157,887 | 11/1964 | Rothstein | 2/203 |
| 3,237,210 | 3/1966 | Graber | 2/209.1 |
| 3,531,952 | 10/1970 | Chesebro, Jr. | 66/171 |
| 3,747,124 | 7/1973 | Zientara | 2/202 |
| 3,838,467 | 10/1974 | Zientara | 2/202 |
| 4,272,853 | 6/1981 | Schuessler | 2/424 |
| 4,620,324 | 11/1986 | Parr | 2/91 |
| 4,937,885 | 7/1990 | Gregg | 2/171 |
| 4,951,319 | 8/1990 | Phillips | 2/175 |

FOREIGN PATENT DOCUMENTS

| | | | |
|---|---|---|---|
| 1093702 | 5/1955 | France | 2/202 |

*Primary Examiner*—Werner H. Schroeder
*Assistant Examiner*—Diana L. Biefeld
*Attorney, Agent, or Firm*—Michael B. Farber

[57] ABSTRACT

A ski hat has an outer substantially tubular shell of flexible laminated fabric having top and bottom apertures to be placed over the head. The laminated fabric comprises three layers, an outer layer and inner layer each of spandex fabric, and a middle layer of microporous polyurethane laminate. The shell has top and bottom apertures. The hat has a flexible outer band surrounding the top aperture and a drawstring for reversibly tightening the flexible outer band surrounding the top aperture. The hat further can have protrusions integral with the substantially tubular shell and adjacent to the bottom aperture of the shell for covering the ears. The ear flaps can be lined with a layer of insulating fabric such as fleece-knit polyester bunting. The ski hat can further comprise a head covering for covering the top of the head joined to the cylindrical shell and made of insulating fabric. The hat can further comprise a foldable mask for covering the nose, mouth and chin attached to the bottom side of the head covering. The mask is lined with a layer of insulating fabric and is capable of being placed over the nose so as to leave an air pocket between the mask and the nose to facilitate breathing when in use. The mask is capable of being folded back into the hat when not in use so that the hat can be worn without the mask. The ski hat of the present invention provides comfort for the wearer under a wide variety of weather conditions such as might be encountered during outdoor recreation.

7 Claims, 6 Drawing Sheets

WEATHER-ADAPTABLE SKI HAT

BACKGROUND OF THE INVENTION

The invention is directed to a weather-adaptable ski hat.

Skiing and other outdoor snow sports are naturally performed in cold weather, and participants in these sports require protection for their heads. This protection is typically provided by a ski hat.

However, weather conditions faced by skiers can vary greatly as the temperature, precipitation, humidity, and wind can change rapidly and unpredictably, especially in mountainous areas. In addition, the exertion involved in skiing and other outdoor sports can generate heat which can make the wearer of a conventional ski hat uncomfortable when his head is covered by the hat. Thus, there is a need for a ski hat that can be adapted to varying weather conditions and can be adjusted to provide ventilation to vent heat generated by activity or resulting from a rapid increase in temperature.

Additionally, there exists a need for a ski hat with a mask that is comfortable to wear when in use, and is foldable back into the hat so that the hat can be worn without the mask. Previous ski hats do not have these features.

SUMMARY

We have developed a weather-adaptable ski hat that meets these needs. This hat can be adjusted by the wearer to provide greater protection in cold weather or to provide ventilation in warmer weather by a drawstring at the top, thus providing greater comfort in all weather conditions.

One embodiment of the ski hat of the present invention, designed for the most severe weather conditions, comprises:

(1) a substantially tubular shell of flexible laminated fabric having top and bottom apertures, the flexible laminated fabric being substantially impermeable to liquid water while being permeable to water vapor;

(2) a flexible outer band surrounding the top aperture;

(3) drawstring means for reversibly tightening the flexible outer band surrounding the top aperture;

(4) protrusions integral with the substantially tubular shell and adjacent to the bottom aperture of the substantially tubular shell for covering the ears;

(5) a head covering for covering the top of the head attached to the substantially tubular shell and made of an insulating fabric, the head covering having a top side and a bottom side; and (6) a foldable mask for covering the nose, mouth and chin, attached to the bottom side of the head covering, the mask being made of the same laminated fabric as the substantially cylindrical shell and lined with an additional layer of insulating fabric and capable of being placed over the nose so as to leave an air pocket between the mask and the nose to facilitate breathing when in use, the mask also capable of being folded back into the hat The insulating fabric is preferably fleece-knit polyester bunting. The flexible laminated fabric preferably comprises three layers, an outer layer and an inner layer each of spandex fabric, and a middle layer of microporous polyurethane laminate.

In this embodiment of the hat, the mask can be of sufficient length that it can be inserted into a jacket or a coat that is being worn by the wearer of the mask.

A second embodiment of the ski hat of the present invention is designed for somewhat less severe weather conditions. This embodiment comprises:

(1) a substantially tubular shell of flexible laminated fabric having top and bottom apertures, the flexible laminated fabric being substantially impermeable to liquid water while being permeable to water vapor;

(2) a flexible outer band surrounding the top aperture;

(3) drawstring means for reversibly tightening the flexible outer band surrounding the top aperture;

(4) protrusions integral with the substantially tubular shell and adjacent to the bottom aperture of the substantially tubular shell for covering the ears, the protrusions being lined with a layer of insulating fabric; and (5) a head covering for covering the top of the head inserted between the substantially tubular shell and the layer of insulating fabric lining the protrusions for covering the ears and made of the same insulating fabric as the layer of insulating fabric lining the protrusions, the head covering having a top side and a bottom side when placed on the head.

A third embodiment of the hat of the present invention, intended for relatively mild weather conditions, comprises:

(1) a substantially tubular shell of flexible laminated fabric having top and bottom apertures, the flexible laminated fabric being substantially impermeable to liquid water while being permeable to water vapor;

(2) a flexible outer band surrounding the top aperture; and (3) drawstring means for reversibly tightening the flexible outer band surrounding the top aperture.

This embodiment of the hat can further comprise protrusions integral with the substantially tubular shell and adjacent to the bottom aperture of the substantially tubular shell for covering the ears. The protrusions are lined with a layer of insulating fabric.

BRIEF DESCRIPTION OF THE DRAWINGS

These and other features, aspects, and advantages of the present invention will become better understood with reference to the following description, appended claims, and accompanying drawings where:

DESCRIPTION

Figure 1:
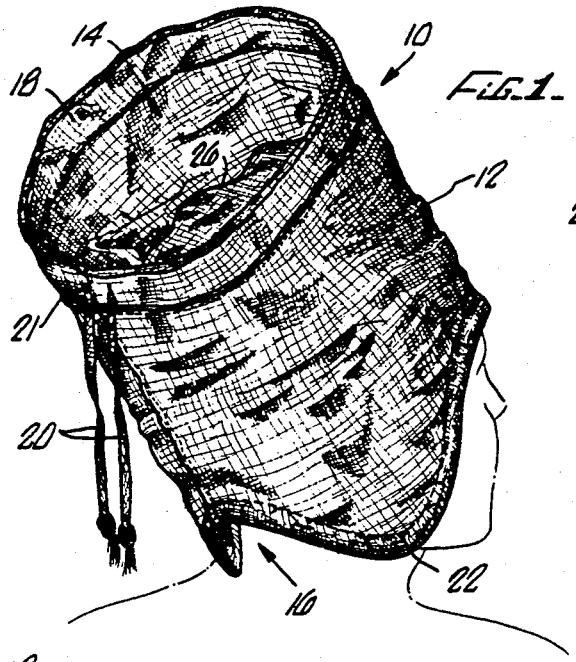
FIG. 1 is a perspective view of a first embodiment of the hat, intended for the most severe weather conditions, with both a head covering and a mask, showing the top aperture open.

We have developed a weather-adaptable ski hat that can be adjusted to provide ventilation and can be adapted to varying weather conditions.

One embodiment of the ski hat 10, shown generally in FIGS. 1-12, comprises a substantially tubular shell 12 of flexible laminated fabric having top 14 and bottom 16 apertures to be placed over the head, a flexible outer band 18 surrounding the top aperture 14, drawstring means such as a drawstring 20 for reversibly tightening the flexible outer band 18, protrusions 22 for covering the ears integral with the substantially cylindrical shell 12 and adjacent to the bottom aperture 16 of the substantially tubular shell 12 for covering the ears, a head covering 24 inserted between the cylindrical shell 12 and the protrusions 22 and having a top side 26 and a bottom side 28, and a foldable mask 30 for covering the nose, mouth and chin attached to the bottom side 28 of the head covering 24. This version is intended for the most severe weather conditions.

The substantially tubular shell 12 is made of flexible laminated fabric that is substantially impermeable to liquid water while being permeable to water vapor. These properties make the hat resistant to water, such as precipitation, entering from the outside, while at the same time allowing the hat to "breathe" by the escape of water vapor produced by the perspiration of the wearer. This contributes substantially to the comfort of the wearer of the hat. Preferably, the flexible laminated fabric has three layers of material as shown in detailed cross-section in FIG. 10: an outer layer 32 of spandex material such as Lycra TM (DuPont, Wilmington, Del.), or comparable fiber in which the fiber-forming substance is a long-chain synthetic polymer comprised of at least 85% of a segmented polyurethane, a middle layer 34 of a microporous polyurethane laminate such as Fabuthane TM (Fabrite Laminating Corp., Wood Ridge, N.J.), and an inner layer 36 of spandex material. The microporous polyurethane laminate preferably has a tensile strength of at least about 7,000 lbs., and a brittle point down to at least −80° F. The tubular shell 12 has protrusions 22 for covering the ears integral with the shell 12 and adjacent to the bottom aperture 16 of the substantially tubular shell 12.

The drawstring 20 reversibly tightens the flexible top band 18, thus reversibly closing the top aperture 14. The drawstring 20 is inserted in the flexible top band 18 by insertion in the drawstring holes 21. The wearer can use the drawstring 20 to adjust the hat 10 for maximum comfort in varying weather conditions, opening the top aperture 14 in warmer weather and closing the aperture 14 in colder weather. When the top aperture 14 is open, the wearer can partially roll down the hat and wear it as a headband.

The head covering 24 covers the top of the head when the substantially tubular shell 12 is placed around the head. The bottom side 28 of the head covering 24 is in contact with the top of the head when the hat 10 is worn. The head covering 24 is made of insulating fabric. This fabric is preferably a fleece-knit polyester bunting.

Figure 2:
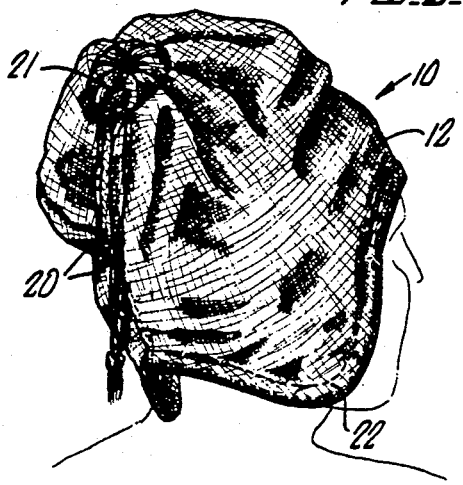
FIG. 2 is a perspective view of the hat of FIG. 1 with the drawstring positioned so as to tighten the flexible outer band, so that the top aperture is closed.
Figure 11:
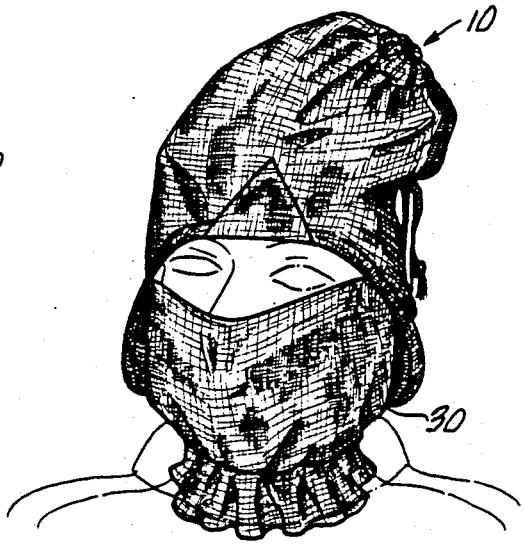
FIG. 11 is a front view of the hat of FIG. 1 as worn with the mask in position on the wearer's face.

The foldable mask 30 covers the nose, mouth, and chin of the wearer when in use. It can be folded back into the hat 10 when not in use so that the hat can be worn as though there were no mask, as shown in FIGS. 1 and 2. The foldable mask 30, when placed over the nose and mouth, leaves a slot for the eyes and forms an air pocket between the mask and the nose so that breathing is facilitated, as shown in FIG. 11, a frontal view of the hat 10 on the head of the wearer showing the positioning of the mask 30. The foldable mask 30 is long enough that it can be inserted into the jacket or coat of the wearer while being worn, as shown in FIG. 11. The foldable mask 30 is made of a flexible laminated fabric having three layers of material as used in the shell 12 bound to an insulating fabric 38 as used in the head covering 24. The insulating fabric 38 is on the interior of the mask 30 so that it is located nearest the head when worn.

This embodiment of the hat 10 is depicted in FIGS. 1-12. FIG. 1 is a perspective view of the hat 10 with the drawstring 20 positioned so as to leave the flexible outer band 18 positioned such that the top aperture 14 is open and the top side 26 of the head covering 24 is exposed. The protrusions 22 cover the ears. The foldable mask 30 is folded back into the hat 10.

FIG. 2 is a perspective view of the hat 10 with the drawstring 20 positioned so as to tighten the flexible outer band 18 leaving the top aperture 14 closed.

Figure 3:
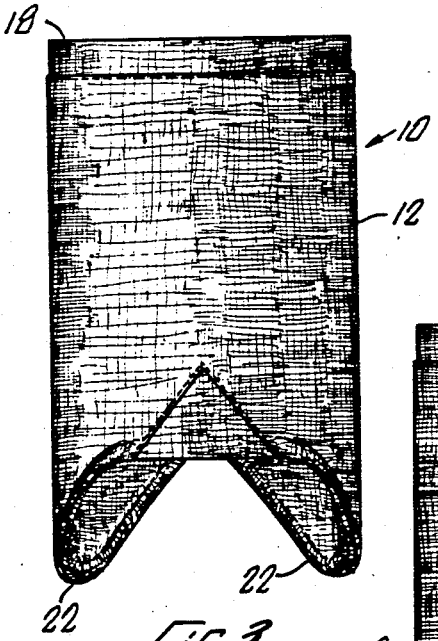
FIG. 3 is a front view of the hat of FIG. 1.
Figure 4:
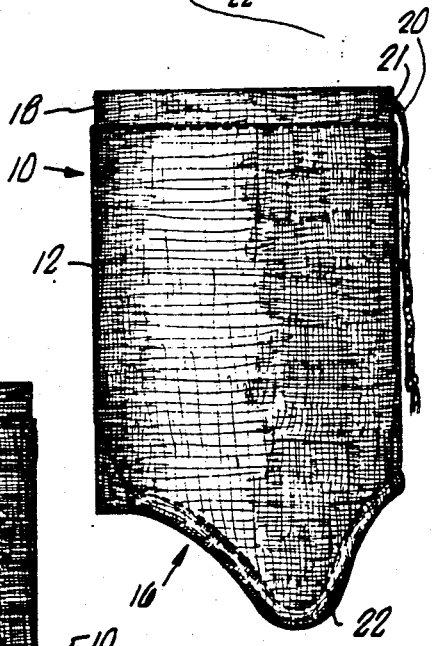
FIG. 4 is a side view of the hat of FIG. 1.
Figure 5:
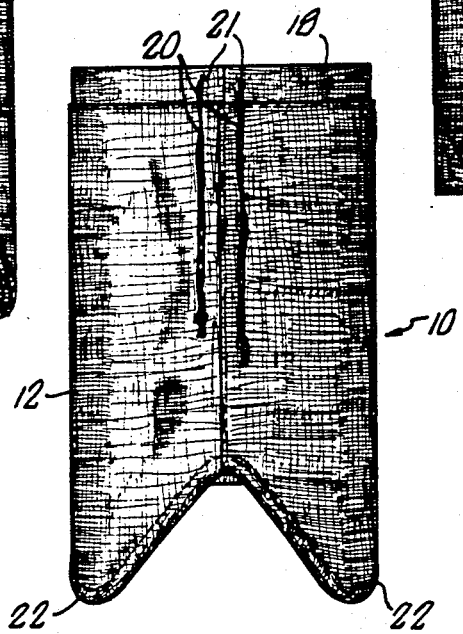
FIG. 5 is a back view of the hat of FIG. 1 centered on the drawstring.

FIG. 3 is a front view of the hat 10, particularly showing the protrusion 22 intended to cover the ears, the outer tubular shell 12, and the flexible outer band 18. FIG. 4 is a side view of the hat 10, also showing the drawstring 20, and FIG. 5 is a back view of the hat 10 centered on the drawstring 20 and showing the drawstring holes 21.

Figure 6:
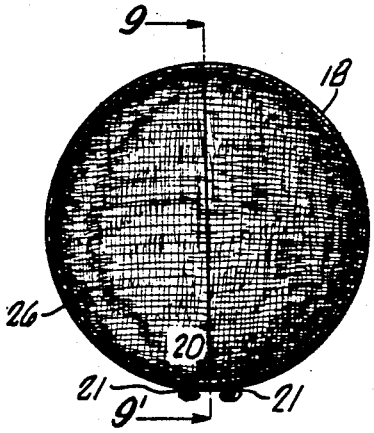
FIG. 6 is a top view of the hat of FIG. 1 with the drawstring open.
Figure 7:
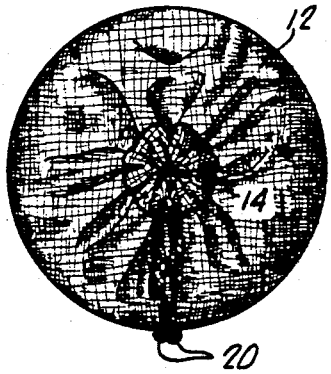
FIG. 7 is a top view of the hat of FIG. 1 with the drawstring positioned so as to completely close the top aperture.
Figure 8:
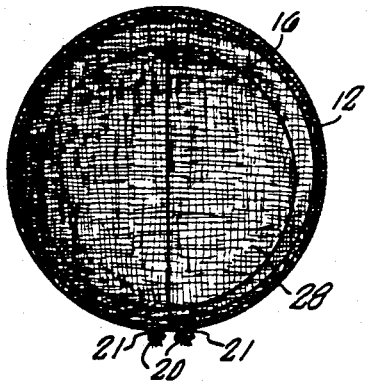
FIG. 8 is a bottom view of the hat of FIG. 1.

FIG. 6 is a top view of the hat 10 with the drawstring 20 open, showing the drawstring holes 21, the flexible outer band 18, and the top side 26 of the head covering 24 exposed. FIG. 6 also indicates a cross-section designated 9—9' through the hat. FIG. 7 is a top view of the hat 10 with the drawstring 20 positioned so as to completely close the top aperture 14, leaving the top surface 26 of the head covering 24 completely covered. FIG. 8 is a bottom view of the hat showing the same cross-section 9—9' as in FIG. 6, showing the substantially tubular shell 12, the bottom surface 28 of the head covering 24, the drawstring 20, and the drawstring holes 21.

Figure 9:
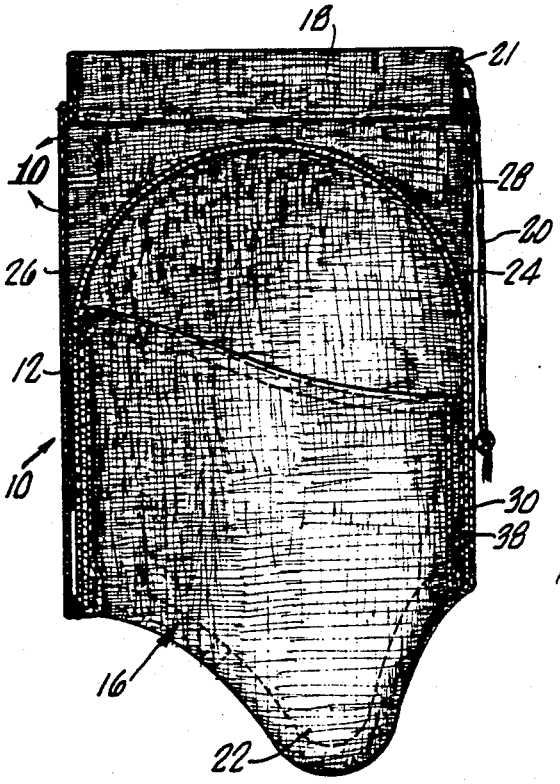
FIG. 9 is a cross-sectional side view of the hat of FIG. 1 taken along line 9—9' in FIG. 6.
Figure 10:
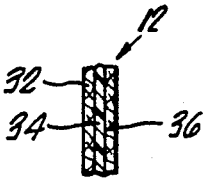
FIG. 10 is a detailed cross-section of the flexible laminated fabric making up the substantially tubular shell of the hat of FIG. 1.

FIG. 9 is a cross-section of the hat 10 looking from the top and cut through the line 9—9' as indicated in FIG. 6, showing the top band 18, the drawstring 20, the drawstring holes 21, the substantially tubular shell 12, the protrusions 22, the mask 30 folded into the hat 10, and the insulating fabric 38. FIG. 10, as indicated above, is a detailed drawing of the three layers of the substantially tubular shell 12, showing the outer layer 32, the middle layer 34, and the inner layer 36.

Figure 12:
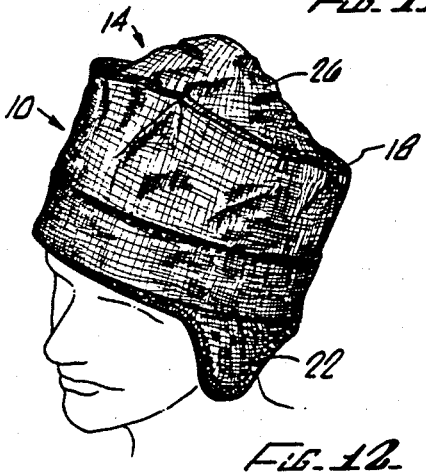
FIG. 12 is a side top view of the hat of FIG. 1 on the head of a wearer, with the top aperture open.

FIG. 11, as indicated above, is a front view of the hat 10 as worn with the mask 30 in position on the wearer's face. FIG. 12 is a side top view of the hat on the head of a wearer, with the top aperture 14 open, showing the exposure of the top side 26 of the head covering 24, as well as the protrusions 22.

A second embodiment of the hat 40, shown generally in FIGS. 13–22, is similar to the first embodiment except that the mask 30 is absent. In this version, the protrusions 22 for covering the ears are integral with the shell 12, but are lined with an insulating fabric, preferably a fleece-knit polyester bunting, such as is used for the head covering 24. This embodiment of the hat has the head covering 24 with top and bottom sides 26 and 28, the drawstring 20, the flexible outer band 18, and the top and bottom apertures 14 and 16, as described for the first embodiment above.

Figure 13:
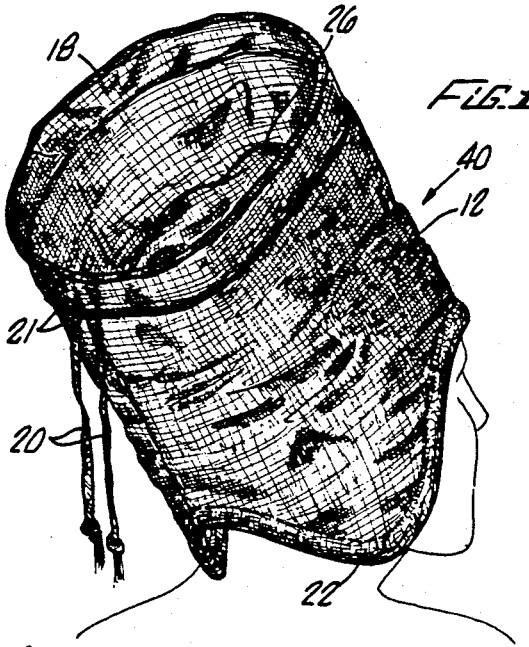
FIG. 13 is a perspective view of a second embodiment of the hat, intended for somewhat less severe weather conditions, with a head covering but without a mask, showing the top aperture open.

FIG. 13 is a perspective view of the hat 40 on the head of the wearer with the drawstring 20 open, so that the flexible outer band 18 is positioned such that the top aperture 14 is open and the top side 26 of the head covering 24 is exposed. FIG. 13 also depicts the position of the protrusions 22 for covering the ears.

Figure 14:
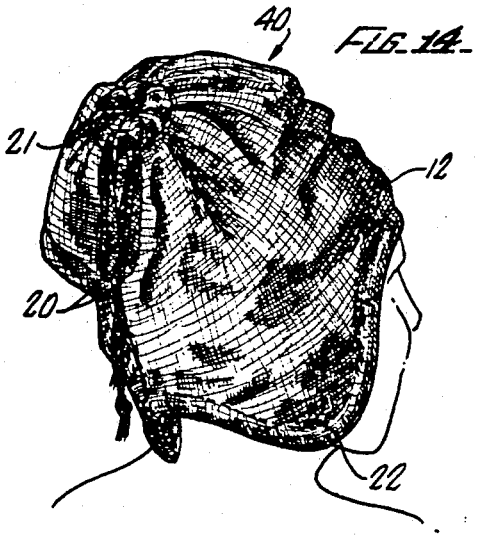
FIG. 14 is a perspective view of the hat of FIG. 13 with the drawstring positioned so as to tighten the flexible outer band, so that the top aperture is closed.

FIG. 14 is a perspective view of the hat 40 on the head of the wearer with the drawstring 20 positioned so as to close the top aperture 14.

Figure 15:
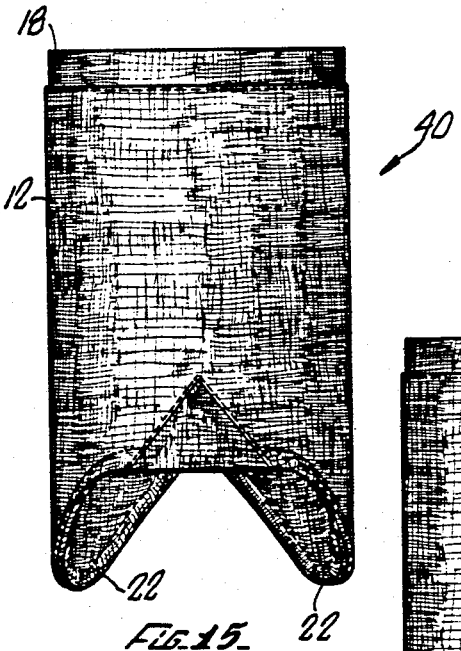
FIG. 15 is a front view of the hat of FIG. 13.
Figure 16:
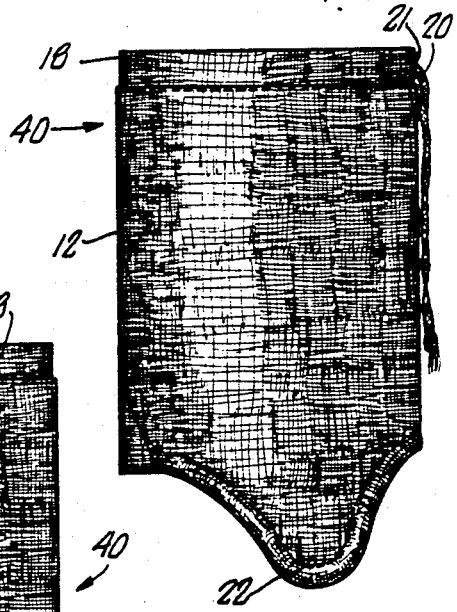
FIG. 16 is a side view of the hat of FIG. 13.
Figure 17:
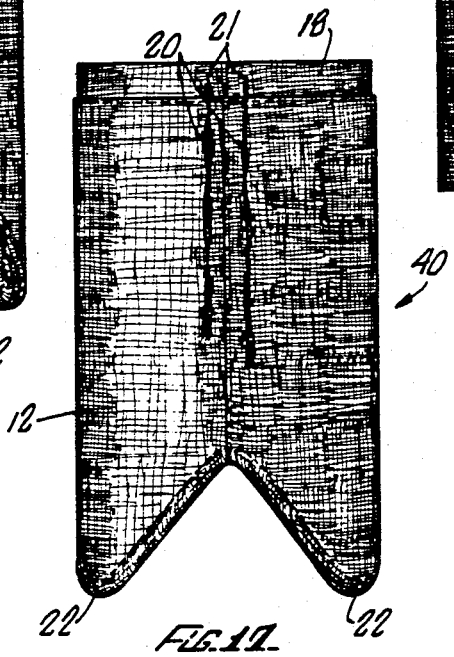
FIG. 17 is a back view of the hat of FIG. 13 centered on the drawstring.

FIG. 15 is a front view of the hat 40 showing the flexible outer band 18, the substantially tubular shell 12, and the protrusions 22 for the ears. FIG. 16 is a side view of the hat 40, showing the flexible outer band 18, the drawstring 20, and the protrusions 22. FIG. 17 is a back view of the hat centered on the drawstring 20 and showing the drawstring holes 21.

Figure 18:
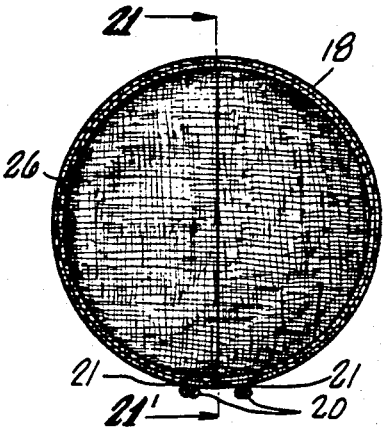
FIG. 18 is a top view of the hat of FIG. 13 with the drawstring open.
Figure 19:
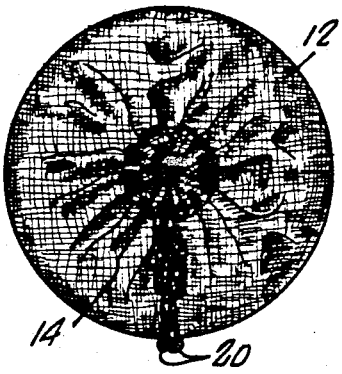
FIG. 19 is a top view of the hat of FIG. 13 with the drawstring positioned so as to completely close the top aperture.
Figure 20:
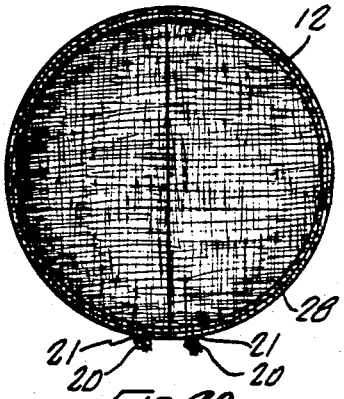
FIG. 20 is a bottom view of the hat of FIG. 13.
Figure 21:
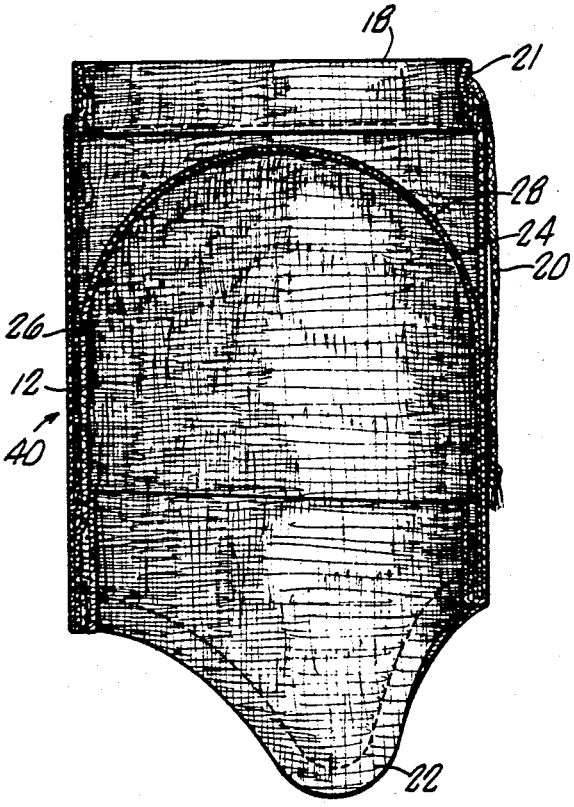
FIG. 21 is a cross-sectional side view of the hat of FIG. 13 taken along line 21—21' in FIG. 18.
Figure 22:
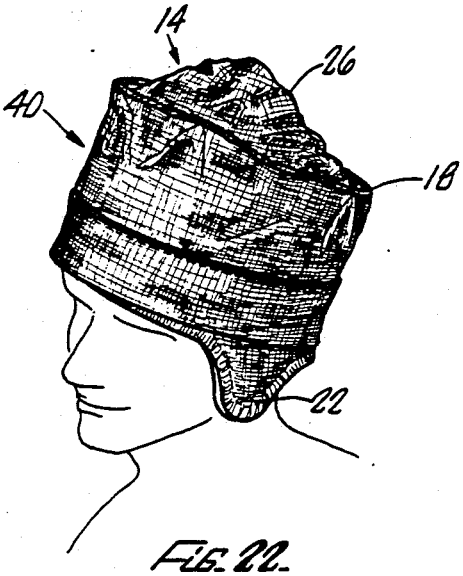
FIG. 22 is a side top view of the hat of FIG. 13 on the head of a wearer, with the top aperture open.

FIG. 18 is a top view of the hat 40 showing the drawstring holes 21 with the drawstring 20 in an open position, so that the flexible outer band 18 is positioned such that the top side 26 of the head covering 24 is exposed. FIG. 18 also indicates a cross-section designated by the letters 21—21'. FIG. 19 is a top view of the hat 40 with the drawstring 20 within the drawstring holes 21 positioned so as to close the top aperture 14, so that the top side 26 of the head covering 24 is not exposed. FIG. 20 is a bottom view of the hat 40 showing the tubular outer shell 12, the drawstring 20, the drawstring holes 21, and the bottom surface 26 of the head covering 24. FIG. 21 is a cross-section of the hat 40 looking from the top cut through 21—21' as shown in FIG. 18, and depicting the flexible outer band 18, the tubular shell 12, the drawstring 20, the drawstring holes 21, the head covering 24, and the protrusions 22 intended for the ears. FIG. 22 is a top side view of the hat 40 on the head of a wearer, with the flexible outer band 18 positioned such that the top surface 26 of the head covering 24 is exposed. The protrusions 22 for covering the ears are also shown.

Figure 23:
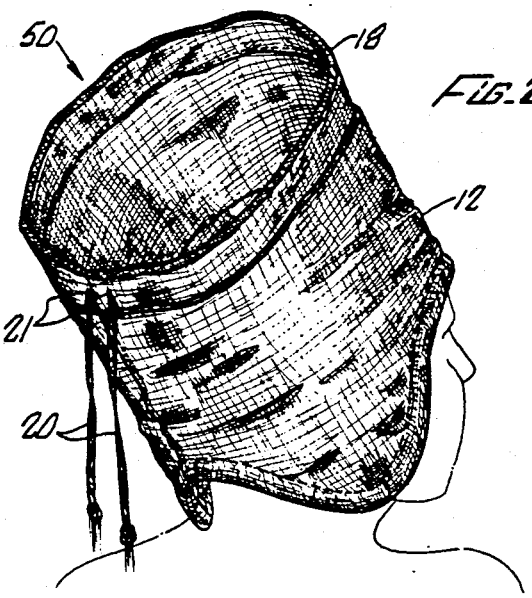
FIG. 23 is a perspective view of a third embodiment of the hat, intended milder weather conditions, without either a head covering or a mask, showing the top aperture open.

A third embodiment of the hat 50 is depicted generally in FIGS. 23–32. In this embodiment of the hat, intended for milder weather conditions, the head covering 24 is absent. The mask 30 is also absent, and the protrusions 22 are optionally present. This version of the hat comprises the substantially tubular shell 12, the flexible outer band 18, and the drawstring 20 inserted into the drawstring holes 21. The optional protrusions 22 for covering the ears are lined with a layer of insulating fabric when present. FIG. 23 shows a perspective view of this embodiment of the hat 50 on the head of a wearer, with the drawstring 20 positioned so that the flexible outer band 18 leaves the top aperture 14 open. The protrusions 22 for covering the ears are also shown. Note that this version lacks a head covering 24, so that when the top aperture 14 is open, the head of the wearer is directly exposed.

Figure 24:
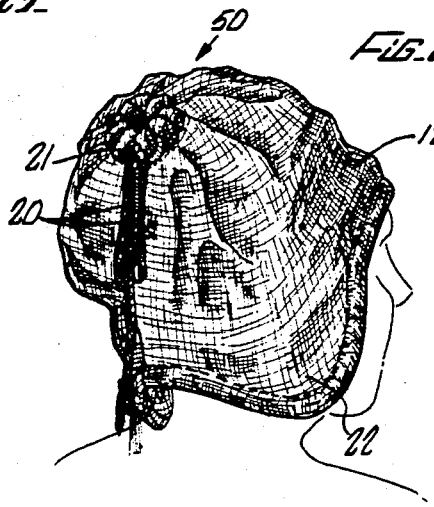
FIG. 24 is a perspective view of the hat of FIG. 23 with the drawstring positioned so as to tighten the flexible outer band, so that the top aperture is closed.

FIG. 24 shows the hat 50 on the head of the wearer with the drawstring 20 positioned such that the flexible outer band 18 closes the top aperture 14.

Figure 25:
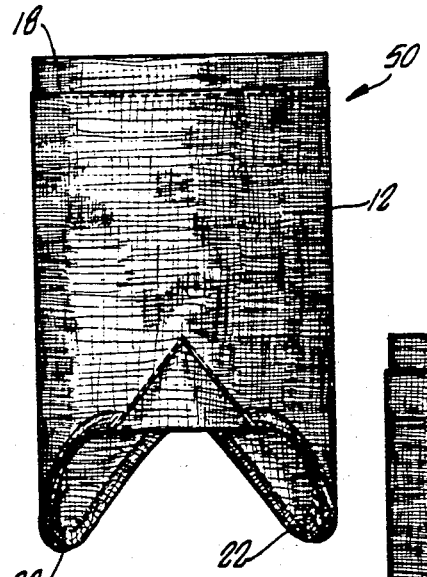
FIG. 25 is a front view of the hat of FIG. 23.
Figure 26:
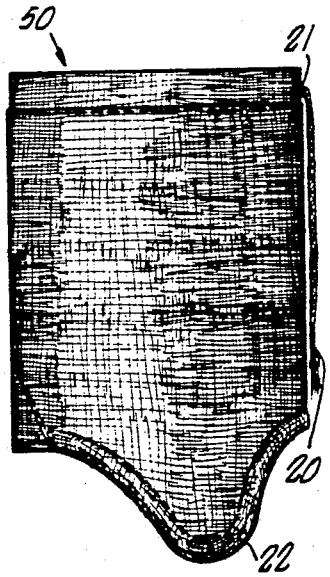
FIG. 26 is a side view of the hat of FIG. 23.
Figure 27:
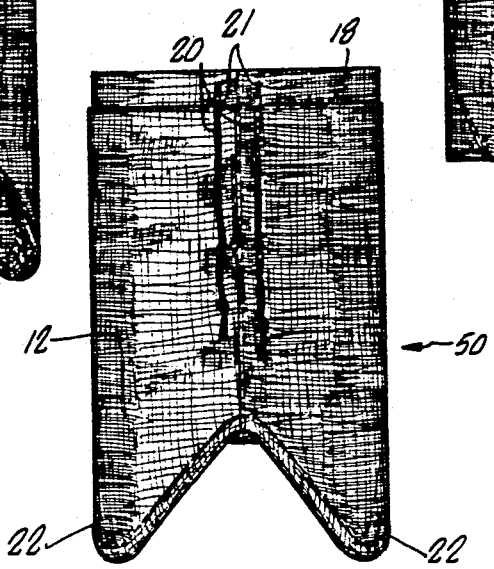
FIG. 27 is a back view of the hat of FIG. 23 centered on the drawstring.
Figure 28:
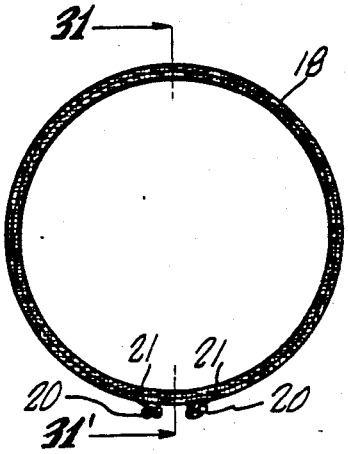
FIG. 28 is a top view of the hat of FIG. 23 with the drawstring open.
Figure 29:
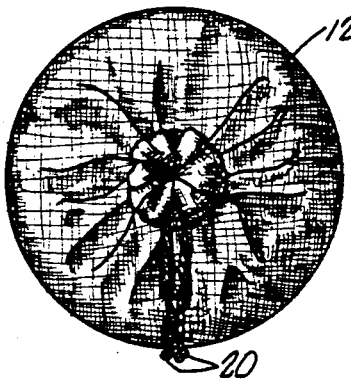
FIG. 29 is a top view of the hat of FIG. 23 with the drawstring positioned so as to completely close the top aperture.
Figure 30:
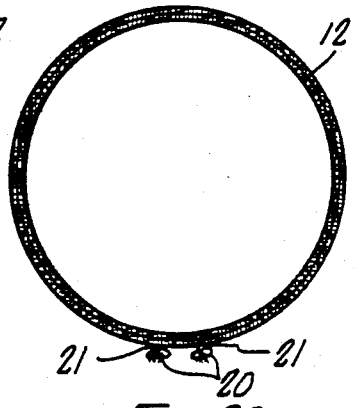
FIG. 30 is a bottom view of the hat of FIG. 23.

FIG. 25 is a front view of the hat 50, showing the substantially tubular shell 12, the top outer band 18, and the protrusions 22 for covering the ears. FIG. 26 is a side view of the hat 50, showing the tubular shell 12, the flexible outer band 18, the drawstring 20, and the protrusions 22 for covering the ears. FIG. 27 is a rear view of the hat 50 centered on the drawstring 20 and showing the drawstring holes 21. FIG. 28 is a top view of the hat 50 with the drawstring 20 inserted into the drawstring holes 21 open, in which the flexible top band 18 is positioned such that the top aperture 14 is open. FIG. 28 also indicates a cross-section designated as 31—31'. FIG. 29 is a top view of the hat 50 showing the drawstring holes and with the drawstring 20 closed, such that the top aperture 14 is closed off. FIG. 30 is a bottom view of the hat 50, showing the drawstring 20, the substantially tubular shell 12, and the bottom aperture 16.

Figure 31:
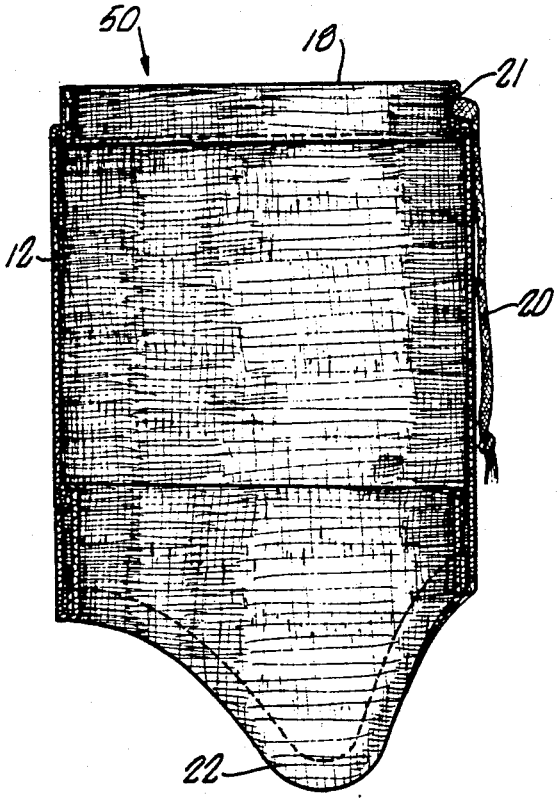
FIG. 31 is a cross-sectional side view of the hat of FIG. 23 taken along line 31—31' in FIG. 28.

FIG. 31 is a cross-section looking from the top cut through 31—31' of FIG. 28, showing the substantially tubular shell 12, the flexible top band 18, the drawstring 20, and the protrusions 22 for covering the ears.

Figure 32:
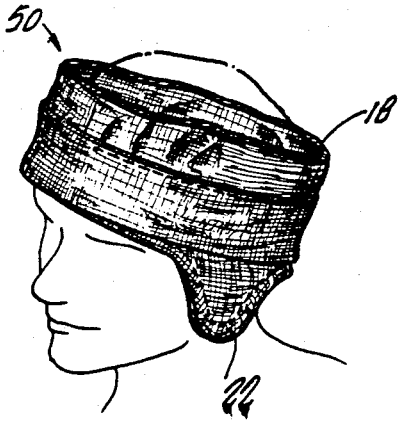
FIG. 32 is a side top view of the hat of FIG. 23 on the head of a wearer, with the top aperture open.

FIG. 32 is a top side view of the hat 50 on the head of a wearer, with the top aperture 14 open leaving the head exposed. FIG. 32 also shows the position of the protrusions 22 for covering the ears on the head of the wearer.

The hat of the present invention provides a number of advantages. It allows the wearer to adjust the top aperture for maximum comfort in a broad range of weather conditions, retaining warmth in extremely cold weather while allowing ventilation in somewhat warmer weather. In particular, it is substantially impervious to precipitation such as rain or snow while being able to "breathe" so that perspiration from the wearer can be dispersed. In the embodiment having a mask, it facilitates breathing when the mask is worn by providing an air pocket between the mask and the face. The mask can be folded back into the hat so that the hat can be comfortably worn without a mask if desired.

Although the present invention has been described and illustrated in considerable detail with regard to certain preferred versions thereof, other versions are possible. Therefore, the spirit and scope of the appended claims should not be limited to the descriptions of the preferred versions contained herein.

What is claimed is:

1. A ski hat comprising:

(a) a substantially tubular shell of flexible laminated fabric having top and bottom apertures, the flexible laminated fabric being substantially impermeable to liquid water while being permeable to water vapor;

(b) a flexible outer band surrounding the top aperture;

(c) drawstring means for reversibly tightening the flexible outer band surrounding the top aperture;

(d) protrusions integral with the substantially tubular shell and adjacent to the bottom aperture of the substantially tubular shell for covering the ears, the protrusions being lined with a layer of insulating fabric; and (e) a head covering for covering the top of the head inserted between the substantially tubular shell and the layer of insulating fabric lining the protrusions for covering the ears and made of the same insulating fabric as the layer of insulating fabric lining the protrusions, the head covering having a top side and a bottom side when placed on the head.

2. The ski hat of claim 1 wherein the insulating fabric is a fleece-knit polyester bunting.

3. The ski hat of claim 1 wherein the flexible laminated fabric comprises three layers, an outer layer and an inner layer each of spandex fabric, and a middle layer of microporous polyurethane laminate.

4. A ski hat comprising:

(a) a substantially tubular shell of flexible laminated fabric having top and bottom apertures, the flexible laminated fabric being substantially impermeable to liquid water while being permeable to water vapor;

(b) a flexible outer band surrounding the top aperture;

(c) drawstring means for reversibly tightening the flexible outer band surrounding the top aperture;

(d) protrusions integral with the substantially tubular shell and adjacent to the bottom aperture of the substantially tubular shell for covering the ears;

(e) a head covering for covering the top of the head attached to the substantially tubular shell and made of an insulating fabric, the head covering having a top side and a bottom side; and (f) a foldable mask for covering the nose, mouth and chin, attached to the bottom side of the head covering, the mask being made of the same laminated fabric as the substantially cylindrical shell and lined with an additional layer of insulating fabric and capable of being placed over the nose so as to leave an air pocket between the mask and the nose to facilitate breathing when in use, the mask also capable of being folded back into the hat.

5. The ski hat of claim 4 wherein the insulating fabric is a fleece-knit polyester bunting.

6. The ski hat of claim 4 wherein the foldable mask is of sufficient length that it can be inserted into a jacket or a coat that is being worn by the wearer of the mask.

7. The ski hat of claim 4 wherein the flexible laminated fabric comprises three layers, an outer layer and an inner layer each of spandex fabric, and a middle layer of microporous polyurethane laminate.

* * * * *